US006412728B1

(12) United States Patent
Jen

(10) Patent No.: US 6,412,728 B1
(45) Date of Patent: Jul. 2, 2002

(54) YARN REEL HAVING A V-SHAPE GRADUALLY NARROWED SLOT WITH REVERSE FISH SCALE SHAPE HAVING A ROUGH SURFACE

(75) Inventor: Zo-Chun Jen, Taipei (TW)

(73) Assignee: Nan Ya Plastics Corporation (TW)

( * ) Notice: Subject to any disclaimer, the term of this patent is extended or adjusted under 35 U.S.C. 154(b) by 0 days.

(21) Appl. No.: 09/657,576

(22) Filed: Sep. 8, 2000

(51) Int. Cl.[7] ..... B65H 65/00; B65H 75/28

(52) U.S. Cl. ..... 242/476.6; 242/125.1; 242/474.7; 242/476.5

(58) Field of Search ..... 242/476.6, 476.5, 242/474.7, 125.1

(56) References Cited

U.S. PATENT DOCUMENTS

| | | | | | |
|---|---|---|---|---|---|
| 1,887,342 | A | * | 11/1932 | Vickerman | 242/125.1 |
| 3,284,023 | A | * | 11/1966 | Sowell | 242/125.1 |
| 4,050,645 | A | * | 9/1977 | Burchette, Jr. et al. | 242/125.1 |
| 4,101,086 | A | * | 7/1978 | Thomas, Jr. | 242/476.5 |
| 4,477,034 | A | * | 10/1984 | Oswald | 242/476.6 |
| 5,228,630 | A | * | 7/1993 | Nakai et al. | 242/476.6 X |
| 5,248,111 | A | * | 9/1993 | Teckentrup et al. | 242/125.1 |
| 5,322,228 | A | * | 6/1994 | Nagayama et al. | 242/476.6 |
| 5,328,121 | A | * | 7/1994 | Rummage | 242/125.1 |
| 5,927,637 | A | * | 7/1999 | Gerhards | 242/476.6 |

FOREIGN PATENT DOCUMENTS

DE 39 23 395 A1 * 2/1990 ..... 242/125.1 X

OTHER PUBLICATIONS

Derwent Acc. No. 1990–038029, Abstract of DE 39 23 395 A1, published Feb. 1, 1990.*

* cited by examiner

*Primary Examiner*—Michael R. Mansen
*Assistant Examiner*—Minh-Chau Pham
(74) *Attorney, Agent, or Firm*—Bacon & Thomas, PLLC

(57) ABSTRACT

A yarn reel having V-shape gradually narrowed slot cut with reverse fish scale shape having a rough surface. The reel includes a "V"-shape wide slot, a v-shape middle-wide slot, a narrow slot and an elongated slot with different widths being gradually set smaller and smaller from the wide slot to the elongated slot on the peripheral surface of said yarn reel. The wide slot being cut to be an open angle having a guide slope at the upper slope of the "V"-shape wide slot, and being cut to have many reverse fish scale shapes with a direction opposite to the yarn guiding direction to form the rough surfaces on both sides of the lower slope of the "V"-shape wide slot. The middle-wide slot is located following the wide slot with a width about one fifth to one sixth of said wide slot. The narrow slot is also cut with many reverse fish scale shapes with a direction opposite to the yarn guiding direction to form the rough surfaces on both sides of the v-shape slope of said narrow slot.

1 Claim, 4 Drawing Sheets

YARN REEL HAVING A V-SHAPE GRADUALLY NARROWED SLOT WITH REVERSE FISH SCALE SHAPE HAVING A ROUGH SURFACE

BACKGROUND OF THE INVENTION

1. Field of the Invention

The present invention relates to an improvement of yarn guide slots setting on the reel surface for winding, and, more particularly to the improvement of yarn grip capability by guiding the yarn winding process with four gradually narrower slots cut on the reel circumferential surface. This construction of yarn reel will provide the advantages of high precision, reel recycling smoothly yarn grip and cost down.

2. Description of the Prior Art

In the automatic operation of yarn winding, it usually involve the step of guiding a yarn to the right position to be smoothly wound around a yarn reel for a great number of times. While leading the yarn to a yarn guide slot forwinding process, the yarn's tension speed will be decreased instantly and sharply because of the sudden drop of winding tension. Accordingly, the yarn can't be gripped easily and smoothly by the reel and consequently can't perform a consistent and high quality job for yarn winding.

Due to the production technique of man-made fibers is updated rapidly, the production of man-made fibers pursues for high speed and diameter's minimization. In addition, because environmental issue is highly regarded the recycling of yarn reel is also a focus of related invention. Recently, some construction improvements of yarn reel are disclosed concerning the enhancement of yarn grip while in mass production. FIG. 1 and FIG. 2 are Japanese Utility Model Patent no. 3-030378 and no. 7-35437 application respectively. FIG. 3 is ROC Utility Model Patent, application no. 85205798. All of them show a conventional yarn reel having either opposite "Z" shape and saw-tooth shape in their slots, or narrowed the slot surface of the reel body in order to improve their capability of yarn grip. However, either "z" or saw-tooth shape is too sharp while the yarn is produced in high speed, and thus cause some yarns are not easily departed from the slot. However, present invention utilizes gradually diminished width for slots and reverse fish scales forming rough surface can easily prevent the defects of traditional yarn reels.

SUMMARY OF THE INVENTION

It is an objective of this invention to provide an improvement of yarn grip capability by cutting different widths and shapes of slots set on the circumferential surface of the reel. Thus, a yarn can be moved thereon smoothly without sticking or interruption. The present invention make the yarn winding cost reduced and the yarn winding result upgraded.

It is another objective of this invention to provide an improved construction of yarn reel for reducing the surface and yarn damage to enable the recycling frequency of the reel and cut down the cost and food for environmental protection.

It is a further objective of this invention to provide a yarn reel construction easily produced and efficiently fit for high-speed production of man-made fibers.

DETAILED DESCRIPTION OF THE PREFERRED EMBODIMENT

Figure 1:
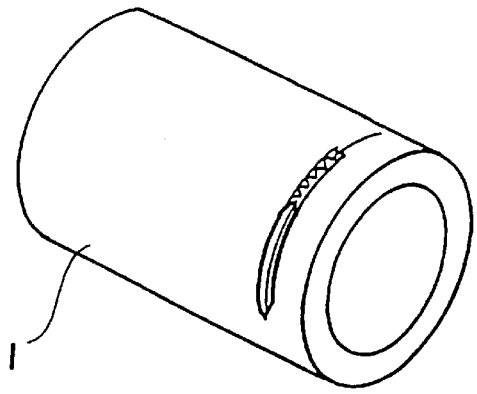
FIG. 1 PRIOR ART
FIG. 1 is a perspective view of Japanese Utility Model Patent no. 3-030378.
Figure 2:
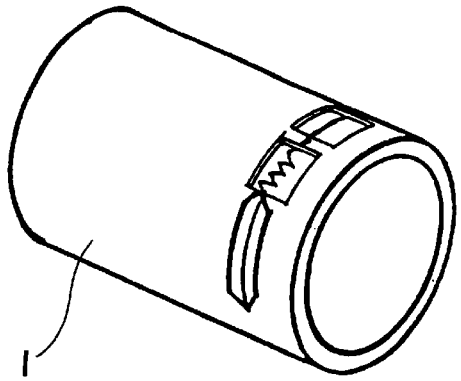
FIG. 2 PRIOR ART
FIG. 2 is a perspective view of Japanese Utility Model Patent application no. 7-35457.
Figure 3:
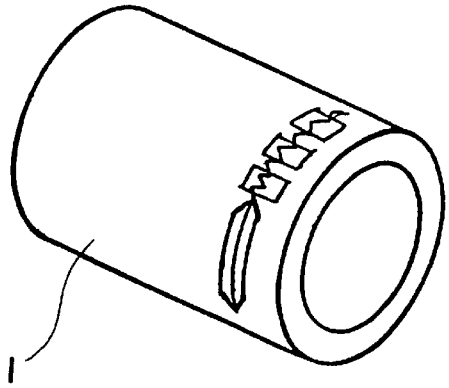
FIG. 3 PRIOR ART
FIG. 3 is a perspective view of ROC Utility Model Patent application no. 85205795.
Figure 4:
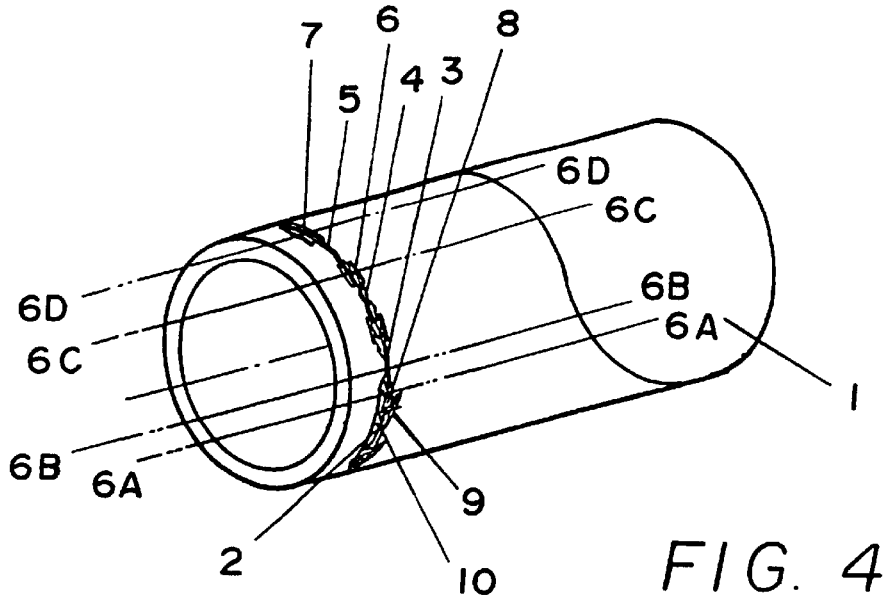
FIG. 4 is a perspective view of this invention.
Figure 5:
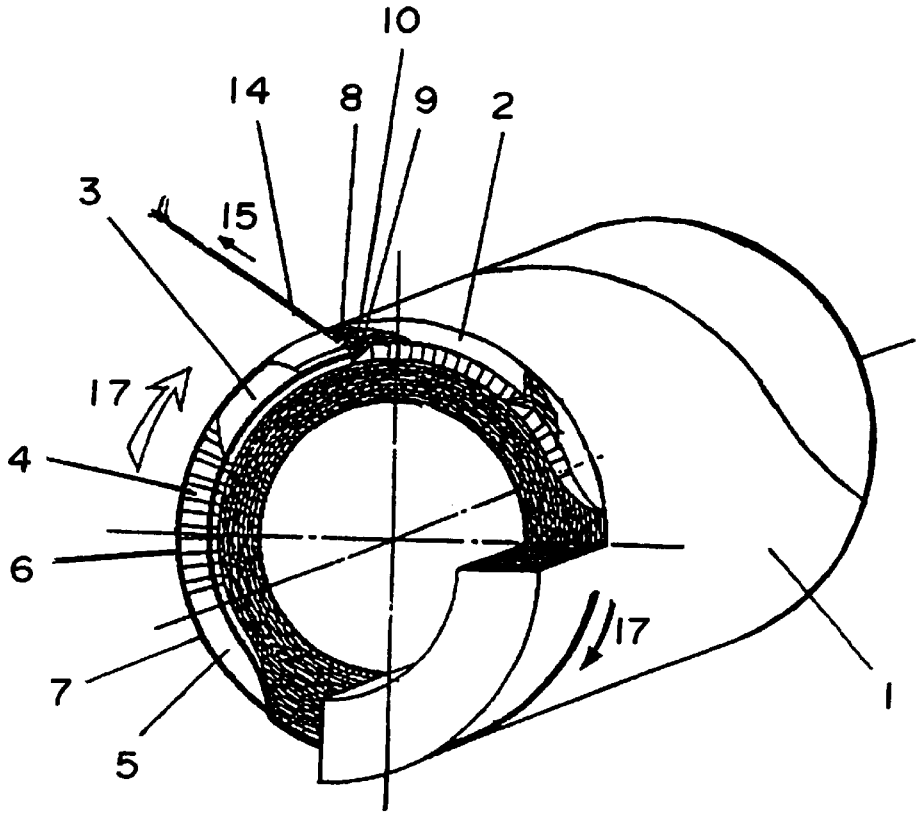
FIG. 5 is a sectional perspective view of this invention.

Referring to FIG. 4, which shows the perspective view of this invention that indicates construction by numbers; 1: reel body; 2: wide slot; 3: middle-wide slot; 4: narrow slot; 5: elongated slot; 6, 7: dents; 8: open angle; 9: guiding slope; 10: yarn hook angle. FIG. 5 is a portion of the partial sectional view showing the "V"-shape wide slot 2, "v"-shape middle-wide slot, narrow slot, and elongated formed by cutting and pressing at an upper area of the reel body 1. Sectional views of details referring to those slots are disclosed by lines 6A—6A, 6B—6B, 6C—6C, and 6D—6D shown in FIG. 6, which clearly shows that the width of the slot is gradually getting smaller from the wide slot to the elongated slot.

Figure 6:
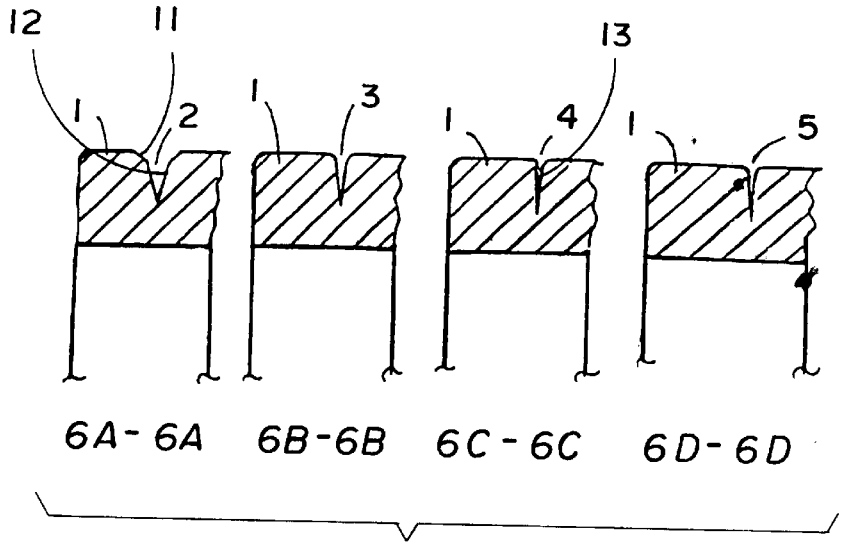
FIG. 6 is a sectional view showing the details of wide slot, middle-wide slot, narrow slot, and elongated slot disclosed in FIG. 4.
Figure 7:
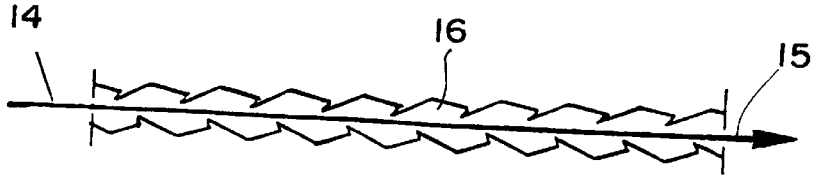
FIG. 7 showing the construction of reverse fish scales of this invention.

FIG. 6 also shows that at the lower slope 12 of the wide slot and the v-shape slope 13 of narrow slot, both sides are cut with many reverse fish scale shapes 16 with a direction opposite to the yarn guiding direction 15 direction to form rough surface like shown in FIG. 7. At the upper slope 11 of wide slot, it is cut an open angle 8 shown in FIG. 8, having a guiding slope 9 and an opposite direction to the yarn guiding direction 15. The rotation direction of the yarn reel is shown as arrow 17.

Wide slot 2 is the start section for yarn entering while in the process of being automatically or manually being wound. Its main purpose is to guide the yarn entering the slot smoothly and to grip and cut off the yarn efficiently. A specially treated cutting device is used to cut the reverse fish scale shape 16 opposite to the yarn guiding direction 15, right on two sides on the lower slope 12 of wide slot to form the rough surface likes shown in FIG. 6. The rough surface can increase the friction force between yarn and surface to significantly upgrade the yarn grip capability. In the meanwhile, the lower slope width of wide slot will become narrower due to the construction of the reverse fish scale surface, and accordingly, can reduce the instant linear speed of guiding the yarn.

Figure 8:
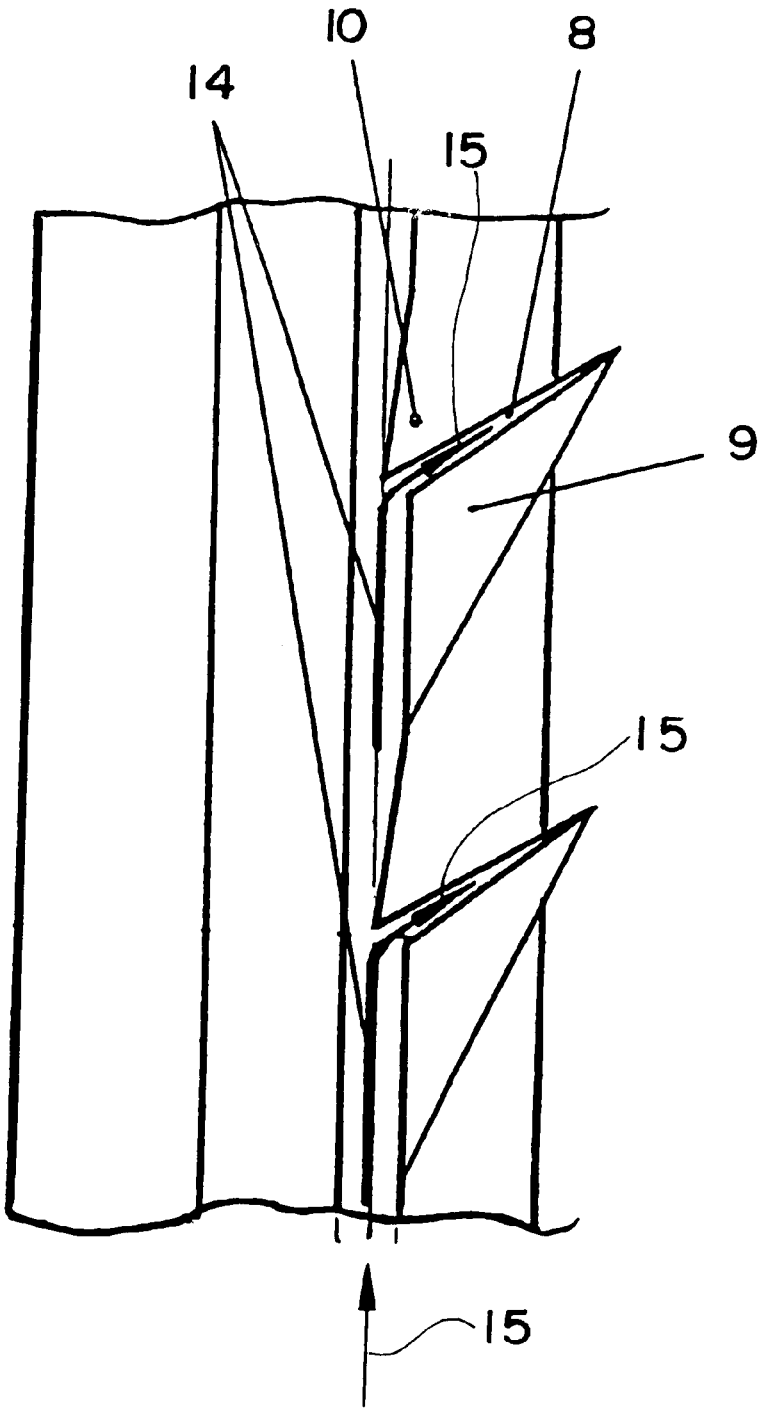
FIG. 8 showing the details of the open angle, the hook angle, and the guiding slope disclosed in FIG. 4.

In order to upgrade the cut-off function of yarn, the upper slope 11 of wide slot is cut an open angle 8 opposite to the yarn guiding direction. This open angle is set at 45–60 degrees with the center-line of wide slot, and is positioned two or three at one or two sides of wide slot. The yarn hook angle 10 is about 4–7 mm long, as shown in FIG. 8, which will be naturally formed when using the special cutting device for making the open angle. It provides the function of yarn cutting and gripping. The guide slope 9 is about 10–20 mm long and is set next to the open angle to lead the yarn entering the angle precisely.

The middle-wide slot 3 is located following the wide slot 2 with a width about one fifth to one sixth of wide slot. It acts as a bridge to be able to deliver the yarn from wide slot to the narrow slot smoothly because of the slow down of the period of tension variation. The narrow slot 4 is located right behind the middle-wide slot. As disclosed in FIG. 6, the two sides of its v-shape slope 13 are cut a number of reverse fish scale shapes opposite to the yarn guiding direction to form a rough surface. This surface can increase the friction force between it and the yarn, and will thus reduce the probability of yarn sliding in the slot.

The elongated slot 5 is positioned right behind the narrow slot with a length about 50–60 mm, providing a function for cutting off the yarn as it enters this slot.

On the surface of narrow slot or elongated slot could be pressed some dents 6, 7 as shown in FIG. 4 to prevent the yarn departing from the slot.

Lastly, because both the directions of the reverse fish scale shape 16 and open angle 8 are opposite to the direction of yarn guiding direction 15, when the yarn 14 is guided into the slot, the yarn grip capability will be excellent. On the other way, when the yarn is departed from the reel from the reverse direction, all the slot surfaces and yarn departing direction become the same and can be easily departed from the reel. As a result, this invention can be recycled without losing its quality.

What is claimed is:

1. A yarn reel having V-shape gradually narrowed slot cut with reverse fish scale shape rough surface and a yarn guiding direction, the yarn reel comprising:

a V-shape wide slot, a v-shape middle-wide slot, a narrow slot and an elongated slot arranged in sequence with widths thereof gradually set smaller and smaller from the V-shape wide slot to the elongated slot on a peripheral surface of the yarn reel, the V-shape wide slot being cut to be an open angle having a guide slope at an upper slope thereof, the slots including cuts having a plurality of reverse fish scale shapes with a direction opposite to the yarn guiding direction to form rough surfaces on both sides of a lower slope of the V-shape wide slot;

the v-shape middle-wide slot is located following the V-shape wide slot with a width about one fifth to one sixth of the V-shape wide slot; and the narrow slot includes the plurality of reverse fish scale shapes with the direction opposite to the yarn guiding direction to form the rough surfaces on both sides of a v-shape slope of the narrow slot.

* * * * *